US007394913B2

(12) United States Patent
Matsuda et al.

(10) Patent No.: US 7,394,913 B2
(45) Date of Patent: Jul. 1, 2008

(54) SPEAKERS

(75) Inventors: Kyoichi Matsuda, Yamagata-ken (JP); Tomiaki Ando, Yamagata-ken (JP); Hiroyuki Kobayashi, Yamagata-ken (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 675 days.

(21) Appl. No.: 10/929,597

(22) Filed: Aug. 31, 2004

(65) Prior Publication Data

US 2005/0047625 A1 Mar. 3, 2005

(30) Foreign Application Priority Data

Sep. 2, 2003 (JP) ..... 2003-310468

(51) Int. Cl.
*H04R 25/00* (2006.01)

(52) U.S. Cl. ..... 381/400; 381/404; 381/407

(58) Field of Classification Search ..... 381/396–398, 381/400, 404, 407, 412
See application file for complete search history.

(56) References Cited

U.S. PATENT DOCUMENTS 4,118,605 A * 10/1978 Kobayashi ..... 381/407
6,118,884 A * 9/2000 Proni ..... 381/403
6,385,327 B1 * 5/2002 D'Hoogh ..... 381/398

FOREIGN PATENT DOCUMENTS

JP 2003-116197 4/2003

* cited by examiner

*Primary Examiner*—Suhan Ni
(74) *Attorney, Agent, or Firm*—Arent Fox LLP

(57) ABSTRACT

A voice coil bobbin coupled to a damper is allowed to vibrate in its axis direction within a magnetic circuit including a magnet and a plate supported by a yoke. A range extending between a neutral position of an end of the voice coil bobbin and a portion of the yoke opposing the end of the voice coil bobbin is longer than a range extending between the plate and a neutral position of a portion where the voice coil bobbin is coupled to the damper. A damper ring is fitted around the voice coil bobbin in a position closer to the plate within the portion where the voice coil bobbin is coupled to the damper. A rear face of the damper ring opposing the plate is shaped in face-geometry parallel to a face of the plate opposing the damper ring.

8 Claims, 3 Drawing Sheets

*FIRST EMBODIMENT*

10

FIRST EMBODIMENT

SECOND EMBODIMENT

20

SPEAKERS

BACKGROUND OF THE INVENTION

1. Field of the Invention

This invention relates to a structure of a speaker.

The present application claims priority from Japanese Application No. 2003-310468, the disclosure of which is incorporated herein by reference.

2. Description of the Related Art

A speaker as illustrated in FIG. 1 includes a voice coil bobbin 3 supported in such a way as to vibrate in an axis direction by a damper 2 placed between a frame 1 and the voice coil bobbin 3.

A voice coil 4 is wound on the outer periphery of the voice coil bobbin 3. A portion of the voice coil bobbin 3 on which the voice coil 4 is wound is inserted into a magnetic circuit gap g provided between a yoke 7 and a combination of a magnet 6 and a plate 5 forming a magnetic circuit, so that the voice coil bobbin 3 is vibrated in its axis direction (in the vertical direction in FIG. 1) by the magnetic circuit.

FIG. 1 also shows a speaker cone 8.

In the speaker structured in this manner, on the application of excessive input to the speaker, a lower portion of the voice coil bobbin 3 vibrating toward the rear of the speaker (vibration downward in FIG. 1) may come into collision with the yoke 7. This collision may damage the voice coil bobbin 3, which in turn may possibly make the speaker inoperable.

For this reason, in the conventional speakers as described above, a range a extending between a portion of the yoke 7, which opposes a rear end (the lower end in FIG. 1) of the voice coil bobbin 3, and a neutral position of the rear end of the voice coil bobbin 3 is longer than a range b extending between the plate 5 and a neutral position of a portion of the coupling between the voice coil bobbin 3 and the damper 2, in order to avoid collision of the voice coil bobbin 3 with the yoke 7 when excessive input is applied to the speaker.

Such a speaker is disclosed by Japanese Unexamined Patent Application No. 2003-116197, for example.

However, in consequence of such design for avoiding collision of a rear end of the voice coil bobbin 3 with the yoke 7, on the application of excessive input to the speaker, the coupling portion between the voice coil bobbin 3 and the damper 2 comes into collision with the plate 5 to cause a fracture in an adhesive A fixedly bonding the damper 2 and a speaker cone 8 to the voice coil bobbin 3. Hence, the conventional speakers as described above have the alternative problems of the speaker producing a defective sound output due to a malfunction in the voice coil, and abnormal sound being generated by the broken pieces of the adhesive A.

SUMMARY OF THE INVENTION

It is an object of the invention to solve the problems associated with the conventional speakers structured as described above.

To achieve this object, a speaker according to the present invention is structured such that: a voice coil bobbin coupled to a damper is allowed to vibrate in its axis direction within a magnetic circuit including a magnet and a plate supported by a yoke; a range extending between a neutral position of an end of the voice coil bobbin and a portion of the yoke opposing the end of the voice coil bobbin is longer than a range extending between the plate and a neutral position of a portion of the voice coil bobbin coupled to the damper; and a ring member is fitted around the voice coil bobbin in a position closer to the plate within the portion of the voice coil bobbin coupled to the damper, and has a face opposing the plate and shaped in face-geometry parallel to a face of the plate opposing the ring member.

These and other objects and features of the present invention will become more apparent from the following detailed description with reference to the accompanying drawings.

DETAILED DESCRIPTION OF THE PREFERRED EMBODIMENTS

Preferred embodiments according to the present invention will be described below in detail with reference to the accompanying drawings.

Figure 2:
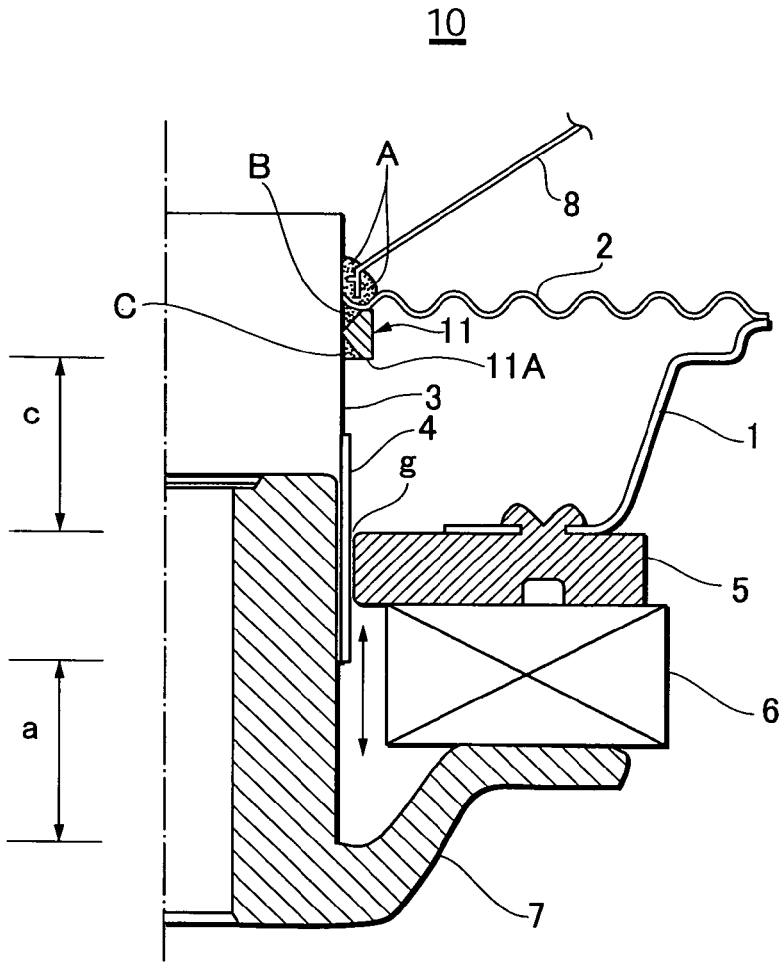
FIG. 2 is a sectional side view illustrating a first embodiment of the present invention.

FIG. 2 is a sectional side view illustrating a first embodiment of a speaker according to the present invention.

In FIG. 2, a speaker 10 includes a damper 2 placed between a frame 1 and a voice coil bobbin 3. The voice coil bobbin 3 is supported by the damper 2 in such a way as to vibrate in its axis direction.

A voice coil 4 is wound on the outer peripheral face of the voice coil bobbin 3. A portion of the voice coil bobbin 3 on which the voice coil 4 is wound is inserted into a magnetic circuit gap g between a yoke 7 and a combination of a magnet 6 and a plate 5 forming a magnetic circuit. The magnetic circuit causes vibration of the voice coil bobbin 3 in the axis direction (the vertical direction in FIG. 2) of the voice coil bobbin 3.

Further, a speaker cone 8 is coupled to a leading end (the upper portion in FIG. 2) of the voice coil bobbin 3 at a position closer to the top of the leading end than the damper 2 is coupled to the leading end at a position.

Inner rims of both the speaker cone 8 and the damper 2 are secured to the voice coil bobbin 3 with an adhesive A.

Figure 1:
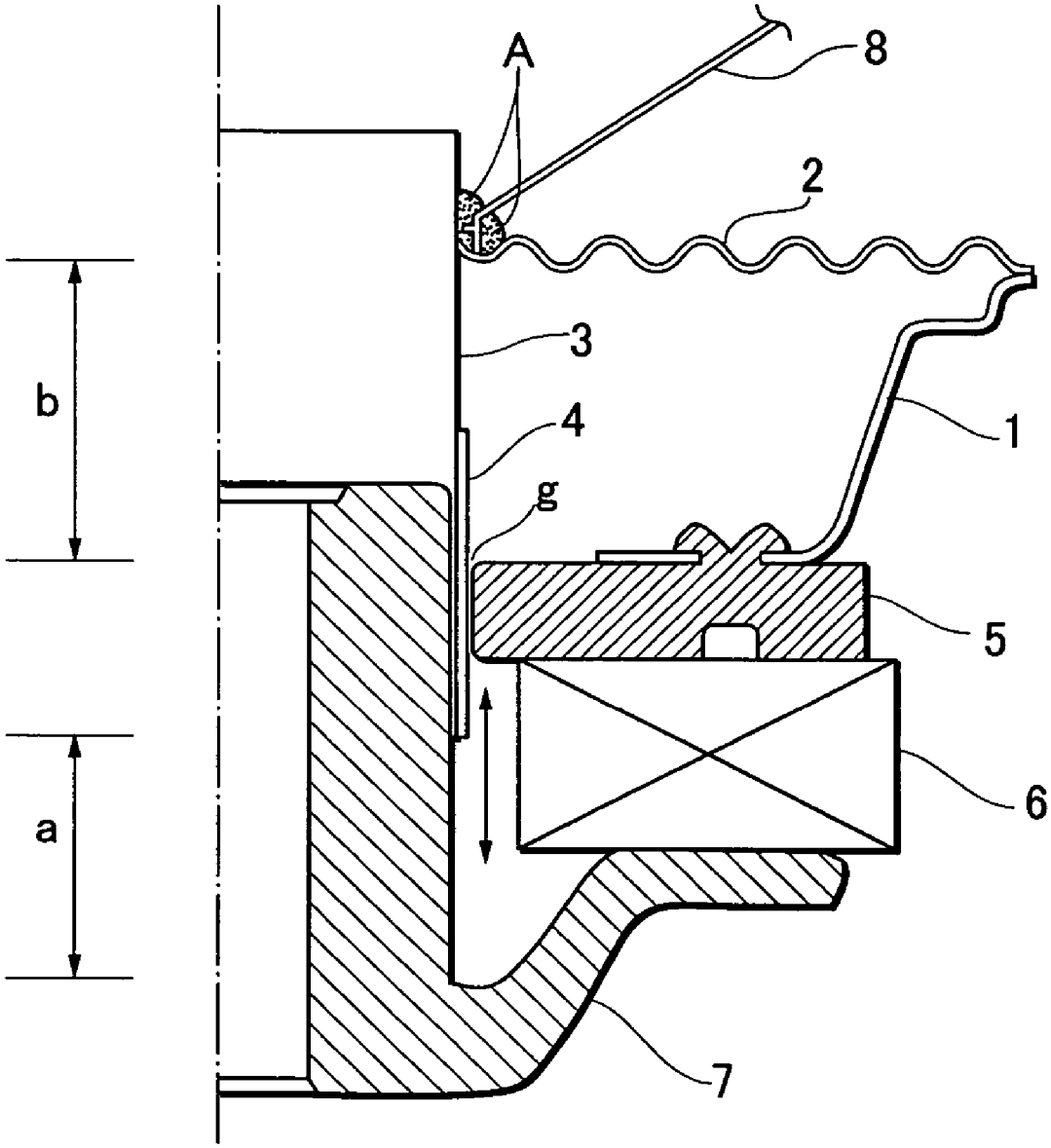
Fig.1 RELATED ART
FIG. 1 is a sectional side view showing part of a conventional speaker.

The structure of the speaker 10 as described above is similar to the structure of the conventional speaker described in FIG. 1. The same components as those of the speaker in FIG. 1 are designated with the same reference numerals as those in FIG. 1.

Figure 3:
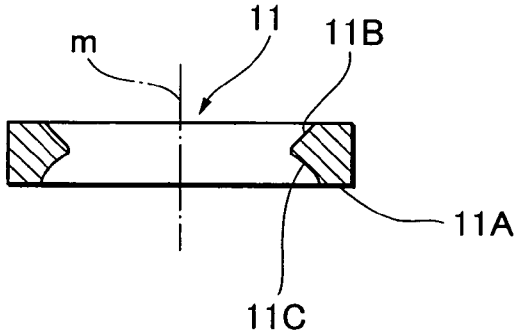
FIG. 3 is a sectional side view illustrating a damper ring in the first embodiment.

In the speaker 10, a damper ring 11 shaped as illustrated in FIG. 3 is fitted around and fixed to a portion of the voice coil bobbin 3 immediately behind (beneath in FIG. 2) the coupling positions to the damper 2 and the speaker cone 8.

The damper ring 11 has a rear face (the lower face in FIGS. 2 and 3) 11A formed in a flat shape at right angles to an axis m of the damper ring 11. When the damper ring 11 is fitted around and secured to the voice coil bobbin 3, the rear face 11A is positioned parallel to a front face (the upper face in FIG. 2) of the opposing plate 5.

The damper ring 11 further has a first adhesive-filled recess 11B formed in the inner rim of a front face (the upper face in FIGS. 2 and 3) of the damper ring 11, and a second adhesive-filled recess 11C formed in the inner rim of a rear face (the lower face in FIGS. 2 and 3) of the damper ring 11.

The damper ring 11 is fitted around the voice coil bobbin 3 prior to the assembly of the speaker 10, and is temporally secured thereto with an adhesive C injected into the second adhesive-filled recess 11C.

After that, in the assembly of the speaker 10, the damper ring 11 is firmly secured together with the damper 2 to the voice coil bobbin 3 with an adhesive B injected into the first adhesive-filled recess 11B.

The speaker 10 is structured such that a range a extending between a portion of the yoke 7 opposing a rear end (the lower end in FIG. 2) of the voice coil bobbin 3 and a neutral position of the rear end of the voice coil bobbin 3 is set longer than a range c extending between the plate 5 and a neutral position of the rear face 11A of the damper ring 11.

In the speaker 10, the rear face 11A of the damper ring 11 comes into collision with the plate 5 on the application of excessive input. Hence collision of the rear end of the voice coil bobbin 3 and the yoke 7 is avoided, and also the damper ring 11 protects the portion of the coupling between the voice coil bobbin 3 and the combination of the damper 2 and the speaker cone 8 from coming into collision with the plate 5.

In the case of collision of the rear face 11A of the damper ring 11 with the plate 5 occurring when excessive input is applied to the speaker 10, the collision is a face-to-face collision because the rear face 11A is a flat face parallel to the plate 5. Hence, it is possible to prevent the occurrence of a situation in which impact acting on the damper ring 11 upon the collision is one-sided causing the voice coil bobbin 3 to be inclined with respect to the vibrating direction of the voice coil bobbin 3.

Because the rear face 11A of the damper ring 11 to come into collision with the plate 5 is a flat face parallel to the plate 5, a load caused by the impact per unit area in the collision face between the rear face 11A and the plate 5 is decreased. Therefore, an excessive load does not act only on a point in the collision area. Accordingly, it is possible to prevent breakage of the portion of the attachment between the voice coil bobbin 3 and the damper ring 11, and also breakage of the portion of the coupling between the voice coil bobbin 3 and the damper 2 and speaker cone 8.

Figure 4:
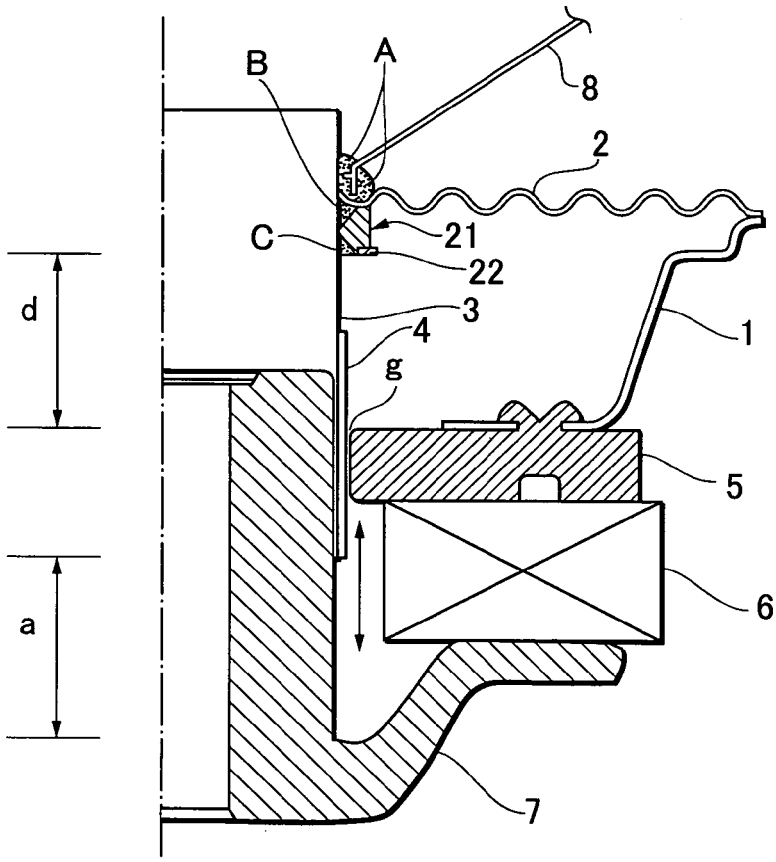
FIG. 4 is a sectional side view illustrating a second embodiment of the present invention.

FIG. 4 is a sectional side view illustrating a second embodiment of a speaker according to the present invention.

In FIG. 4, a speaker 20 includes a damper 2 placed between a frame 1 and a voice coil bobbin 3. The voice coil bobbin 3 is supported by the damper 2 in such a way as to vibrate in its axis direction.

A voice coil 4 is wound on the outer peripheral face of the voice coil bobbin 3. A portion of the voice coil bobbin 3 on which the voice coil 4 is wound is inserted into a magnetic circuit gap g provided between a yoke 7 and a combination of a magnet 6 and a plate 5 forming a magnetic circuit. The magnetic circuit produces vibration of the voice coil bobbin 3 in its axis direction (vertical direction in FIG. 4).

A speaker cone 8 is coupled to a leading end (the upper end in FIG. 4) of the voice coil bobbin 3 at a position closer to the top of the leading end than the damper 2 is coupled to the leading end at a position.

The speaker cone 8 and the damper 2 are both secured at their inner rims to the voice coil bobbin 3 with an adhesive A.

The structure of the speaker 20 as described above is similar to the structure of the speaker 10 described in FIG. 2. The same components as those of the speaker in FIG. 2 are designated with the same reference numerals as those in FIG. 2.

Figure 5:
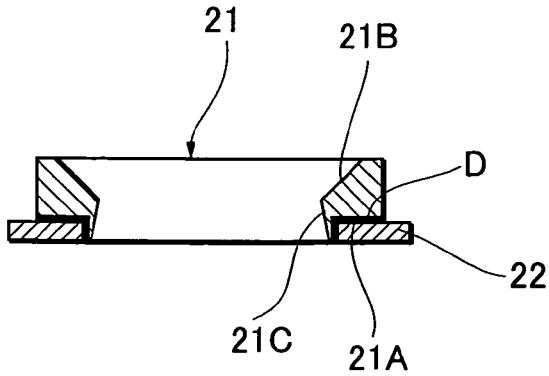
FIG. 5 is a sectional side view illustrating a damper ring in the second embodiment.

In the speaker 20, a damper ring 21 shaped as illustrated in FIG. 5 is fitted around and fixed to a portion of the voice coil bobbin 3 immediately behind (beneath in FIG. 4) the portion to which the damper 2 and the speaker cone 8 are coupled.

The damper ring 21 has an annular-shaped groove 21A formed in the outer rim of the rear face (the lower face in FIGS. 4 and 5) of the damper ring 21. The groove 21A opens backward of the speaker and circumferentially outward of the damper ring 21.

The damper ring 21 further has a first adhesive-filled recess 21B formed in the inner rim of the front face (the upper face in FIGS. 4 and 5) of the damper ring 21, and a second adhesive-filled recess 21C formed in the inner rim of the rear face (the lower face in FIGS. 4 and 5).

A plate-ring-shaped cushion 22 made of elastic materials is fitted into the groove 21 and is secured to the damper ring 21 with an adhesive D.

At this point, the cushion 22 is attached to the damper ring 21 such that the rear face of the cushion 22 is located at right angles to the axis of the voice coil bobbin 3.

The damper ring 21 is fitted around the voice coil bobbin 3 prior to the assembly of the speaker 20, and is temporally secured thereto with an adhesive C injected into the second adhesive-filled recess 21C.

After that, in the assembly of the speaker 20, the damper ring 21 is firmly secured together with the damper 2 to the voice coil bobbin 3 with an adhesive B infected into the first adhesive-filled recess 21B.

The speaker 20 is structured so that a range a extending between a portion of the yoke 7 opposing a rear end (the lower end in FIG. 4) of the voice coil bobbin 3 and a neutral position of the rear end of the voice coil bobbin 3 is longer than a range d extending between the plate 5 and a neutral position of the rear face of the cushion 22 attached to the damper ring 21.

In the speaker 20, the cushion 22 attached to the damper ring 21 comes into collision with the plate 5 on the application of excessive input. Hence collision of the rear end of the voice coil bobbin 3 and the yoke 7 is avoided, and also the damper ring 21 protects the portion of the coupling between the voice coil bobbin 3 and a combination of the damper 2 and the speaker cone 8 from coming into collision with the plate 5.

In the case of collision of the damper ring 21 with the plate 5 occurring when excessive input is applied to the speaker 20, the cushion 22 serves as a shock absorbing material to lessen the impact of the collision and to suppress abnormal sound derived from the collision.

The damper ring 21 is required to have a predetermined hardness from the viewpoint of adhesion to the voice coil bobbin 3 and strength to resist an impact. Hence, the attachment of the cushion 22 makes it possible to prevent occurrence of a loud impact sound and/or breakage in the area of the collision when the hard-material-made damper ring 21 comes into collision with the plate 5.

The cushion 22 also makes it possible to prevent the voice coil bobbin 3 from being ruptured by impact at the time of the collision of the damper ring 21 with the plate 5.

In other words, the voice coil bobbin 3 undergoes the application of a force urging the voice coil bobbin 3 toward the bottom face (the lower side of FIG. 4) of the yoke 7 which is caused by the magnetic circuit, and a force stopping the vibration of the voice coil bobbin 3 which is caused by the collision between the damper ring 21 and the plate 5. In this way, an enormous load is imposed on the voice coil bobbin 3, but the cushion 22 absorbs the load.

The cushion 22 has a face parallel to the plate 5, so that the cushion 22 comes into face-to-face collision with the plate 5. Hence, it is possible to prevent the occurrence of a situation in which impact acting on the damper ring 21 upon the collision is one-sided causing the voice coil bobbin 3 to be inclined with respect to the vibrating direction of the voice coil bobbin 3.

A load caused by the impact per unit area in the collision face between the damper ring 21 and the plate 5 is decreased, so that an excessive load does not act only on any point in the collision area. Accordingly, it is possible to prevent breakage of the portion of the attachment between the voice coil bobbin 3 and the damper ring 21, and also breakage of the portion of the coupling between the voice coil bobbin 3 and a combination of the damper 2 and the speaker cone 8.

The speaker described in each of the first and second embodiments is based on the fundamental idea of a speaker structured such that: a voice coil bobbin coupled to a damper is allowed to vibrate in its axis direction within a magnetic circuit including a magnet and a plate supported by a yoke; the range extending between a neutral position of an end of the voice coil bobbin and a portion of the yoke opposing the end of the voice coil bobbin is longer than the range extending between the plate and a neutral position of a portion of the voice coil bobbin coupled to the damper; and a ring member is fitted around the voice coil bobbin in a position closer to the plate within the portion of the voice coil bobbin coupled to the damper, and has a face opposing the plate and shaped in face-geometry parallel to a face of the plate opposing the ring member.

In the speaker based on this fundamental idea, a range extending between a neutral position of an end of the voice coil bobbin and a portion of the yoke opposite to the end of the voice coil bobbin is longer than a range extending between the plate and a neutral position of the portion where the voice coil bobbin is coupled to the damper. Due to this design, when an excessive input is applied to the speaker, the ring member comes into collision with the plate, so that collision of the voice coil bobbin with the yoke is avoided. In addition, the ring member protects the coupling portion between the damper and the voice coil bobbin from collision with plate.

In the case of collision between the face of the ring member opposing the plate and the plate occurring when excessive input is applied to the speaker, the collision is a face-to-face collision because the face of the ring member has face-geometry parallel to the plate. Hence, it is possible to prevent the occurrence of a situation in which impact acting on the ring member upon the collision is one-sided causing the voice coil bobbin to be inclined with respect to the vibrating direction of the voice coil bobbin.

Because the face of the ring member which comes into collision with the plate is shaped parallel to the plate, a load caused by the impact per unit area in the collision face between the face and the plate is decreased. Therefore, an excessive load does not act only on a point of the collision area. Accordingly, it is possible to prevent breakage of a portion of the attachment between the voice coil bobbin and the ring member, and also breakage of a portion of the coupling between the voice coil bobbin and the damper.

The terms and description used herein are set forth by way of illustration only and are not meant as limitations. Those skilled in the art will recognize that numerous variations are possible within the spirit and scope of the invention as defined in the following claims.

What is claimed is:

1. A speaker, having a voice coil bobbin directly coupled to a damper and allowed to vibrate in an axis direction of the voice coil bobbin within a magnetic circuit including a magnet and a plate supported by a yoke, and a range extending between a neutral position of an end of the voice coil bobbin and a portion of the yoke opposing the end of the voice coil bobbin which is longer than a range extending between the plate and a neutral position of a portion of the voice coil bobbin coupled to the damper, the speaker comprising:

a ring member that is fitted around the voice coil bobbin in a position closer to the plate within the portion of the voice coil bobbin coupled to the damper, and has a face opposing the plate and shaped in face-geometry parallel to a face of the plate opposing the ring member.

2. A speaker according to claim 1, wherein the face of the ring member opposing the plate is shaped in planar geometry at right angles to an axis direction of the voice coil bobbin.

3. A speaker according to claim 1, wherein the ring member comprises an adhesive-filled recess that is formed in an inner rim portion of the ring member and is filled with an adhesive for securing the ring member to an outer peripheral face of the voice coil bobbin.

4. A speaker according to claim 3, wherein the adhesive-filled recess has a shape allowing for adhesion between the ring member and the damper by use of the adhesive injected in the adhesive-filled recess.

5. A speaker according to claim 3, wherein the ring member further comprises an adhesive-filled recess that is formed in the inner rim portion of the ring member and is filled with an adhesive for temporally securing the ring member to the outer peripheral face of the voice coil bobbin.

6. A speaker according to claim 1, further comprising:

a cushion member attached to the face of the ring member opposing the plate.

7. A speaker according to claim 6, wherein a portion of the cushion member opposing the plate is shaped in face-geometry parallel to the face of the plate opposing the ring member.

8. A speaker according to claim 7, wherein the portion of the cushion member opposing the plate is shaped in planar geometry at right angles to an axis direction of the voice coil bobbin.

* * * * *